US007037467B1

(12) United States Patent
Abiko

(10) Patent No.: US 7,037,467 B1
(45) Date of Patent: May 2, 2006

(54) CR-BASED ALLOY EXCELLENT IN BALANCE BETWEEN STRENGTH AND DUCTILITY AT HIGH TEMPERATURE

(75) Inventor: Kenji Abiko, Miyagi (JP)

(73) Assignee: Japan Science and Technology Agency, Saitama (JP)

( * ) Notice: Subject to any disclaimer, the term of this patent is extended or adjusted under 35 U.S.C. 154(b) by 392 days.

(21) Appl. No.: 09/926,600

(22) PCT Filed: May 26, 2000

(86) PCT No.: PCT/JP00/03399

§ 371 (c)(1),
(2), (4) Date: Nov. 26, 2001

(87) PCT Pub. No.: WO00/73523

PCT Pub. Date: Dec. 7, 2000

(30) Foreign Application Priority Data

May 27, 1999 (JP) ..... 11-148326

(51) Int. Cl.
*C22C 27/06* (2006.01)

(52) U.S. Cl. ..... 420/428; 148/423

(58) Field of Classification Search ..... 420/428; 148/423

See application file for complete search history.

(56) References Cited

U.S. PATENT DOCUMENTS 3,640,700 A * 2/1972 Suzuki et al. ..... 75/10.23
4,118,254 A 10/1978 Knotek et al.
5,662,864 A * 9/1997 Kato et al. ..... 420/70

FOREIGN PATENT DOCUMENTS

| | | |
|---|---|---|
| EP | 429796 | 6/1991 |
| EP | 597129 | 5/1994 |
| JP | 48102023 | 12/1973 |
| JP | 49-18709 | 2/1974 |
| JP | 49113712 | 10/1974 |
| JP | 55154542 | 12/1980 |
| JP | 64-7145 | 2/1989 |
| JP | 3-162545 | 7/1991 |
| JP | 6-49604 | 2/1994 |
| JP | 7-278718 | 10/1995 |
| JP | 8-225899 | 9/1996 |
| JP | 11-80902 | 3/1999 |

OTHER PUBLICATIONS

Machine translation of JP 08-225899, Sep. 1996.*
Dai Kou Ken News. No. 43. No 3, Apr. 1999.
English Language Abstract of JP-7-278718, Oct. 1995.
English Language Abstract of JP-8-225899, Sep. 1996.
English Language Abstract of JP-48-102023, Dec. 1973.
English Language Abstract of JP-55-154542, Dec. 1980.
English Language Abstract of JP-11-80902, Mar. 1999.
English Language Abstract of JP-3-162545, Jul. 1991.
English Language Abstract of JP-6-49604, Feb. 1994.
English Language Abstract of JP-49-113712, Oct. 1974.
English Language Abstract of JP-49-18709, Feb. 1974.
Partial English translation of Dai Kou Ken News. No. 43. No 3, Apr. 1999.

* cited by examiner

*Primary Examiner*—Roy King
*Assistant Examiner*—Harry D. Wilkins, III
(74) *Attorney, Agent, or Firm*—Greenblum & Bernstein, P.L.C.

(57) ABSTRACT

A strength-ductility balance at a high temperature above 1000° C., particularly a high temperature above 1050° C. is improved by rendering a chemical composition of Cr-based alloy into Cr: not less than 60 mass %, C+N: not more than 20 mass ppm, S: not more than 20 mass ppm, O: not more than 100 mass ppm, O as an oxide: not more than 50 mass ppm, and the remainder being Fe and inevitable impurities.

6 Claims, 1 Drawing Sheet

| | Cr mass % | S mass ppm | O mass ppm | O as Oxide mass ppm |
|---|---|---|---|---|
| ○ | 65 | 1.0～5.0 | 10～ 20 | 12～ 18 |
| △ | 65 | 35～ 40 | 35～ 45 | 30～ 40 |
| □ | 65 | 5～ 10 | 120～150 | 80～100 |

CR-BASED ALLOY EXCELLENT IN BALANCE BETWEEN STRENGTH AND DUCTILITY AT HIGH TEMPERATURE

BACKGROUND OF THE INVENTION

1. Field of the Invention

This invention relates to a Cr-based alloy having an excellent strength-ductility balance at high temperatures (not lower than 1000° C., particularly super-high temperature zone of not lower than 1050° C.).

2. Description of Background Information

With the advance of techniques in recent industrial and manufacturing fields and the rise of interest in environmental problem, it is strongly demanded to develop metallic materials having high strength and ductility at higher temperatures, particularly a high temperature zone of not lower than 1000° C.

Incidentally, high-temperature materials used from the old time were mainly Ni-based, Cr-based and Co-based alloys. For example, JP-A-55-154542 proposes Ni-based alloy comprising Cr: 20–35 wt %, Si: 1–8 wt % and C: 1.7–3.5 wt % and forming $M_7C_3$ type carbide, and also JP-A-55-154542 proposes Ni—Co—Cr based alloy comprising Ni: 20–47 wt %, Co: 6–35 wt %, Cr: 18–36 wt %, C: 0.6–2.5 wt % and Si: 0.5–2.5 wt %. However, all of these alloys could be practically used up to only a temperature of about 500° C. And also, these alloys containing a greater amount of Ni or Co have many problems that the cost of the material itself is very expensive and the thermal expansion coefficient is high.

A Cr-based alloy is hopeful as a high-temperature material being cheaper than Ni- or Co-based alloy and small in the thermal expansion coefficient. For example, JP-A-11-80902 proposes a high-Cr alloy containing C: 0.5–1.5 wt %, Si: 1.0–4.0 wt %, Mn: 0.5–2.0 wt % and Cr: 35–60 wt % and enhancing a resistance to erosion and corrosion at a higher temperature. However, even in this high-Cr alloy, it is difficult to obtain a sufficient strength at a high temperature zone, particularly above 1000° C. In order to further increase the strength of such a Cr-based alloy, it is required to more increase the Cr amount. In the conventional technique, however, when the Cr amount is not less than 60 mass %, the ductility is substantially lost, so that there is a problem that the working after the production is impossible. Therefore, the alloy containing Cr of not less than 60 mass % has been not yet put into practical use.

As mentioned above, practical materials having a sufficient strength at the high temperature and a good workability (ductility) is not existent in spite of a situation that it is more increased to demand materials durable to use under a super-high temperature environment.

It is, therefore, an object of the invention to solve the above problems of the conventional technique and to provide Cr-based alloys having an excellent strength-ductility balance, which has never been attained in the conventional alloy, at a high temperature above 1000° C., particularly a high temperature above 1050° C.

BRIEF DESCRIPTION OF THE INVENTION

The inventors have made various studies in order to solve the above problems by using the Cr-based alloy useful from economical reason and thermal expansion coefficient. As a result, it has been found that even in the Cr-based alloy containing Cr of not less than 60 mass %, the ductility can be provided and the high-temperature strength and ductility can be established by controlling contents of C+N, S and O in the alloy and an amount of an oxide to not more than limiting amounts and the invention has been accomplished.

The invention lies in a Cr-based alloy having an excellent strength-ductility balance at higher temperatures, comprising Cr: not less than 60 mass %, C+N: not more than 20 mass ppm, S: not more than 20 mass ppm, O: not more than 100 mass ppm, O as an oxide: not more than 50 mass ppm, and the remainder being Fe and inevitable impurities.

DETAILED DESCRIPTION OF THE INVENTION

Figure 1:
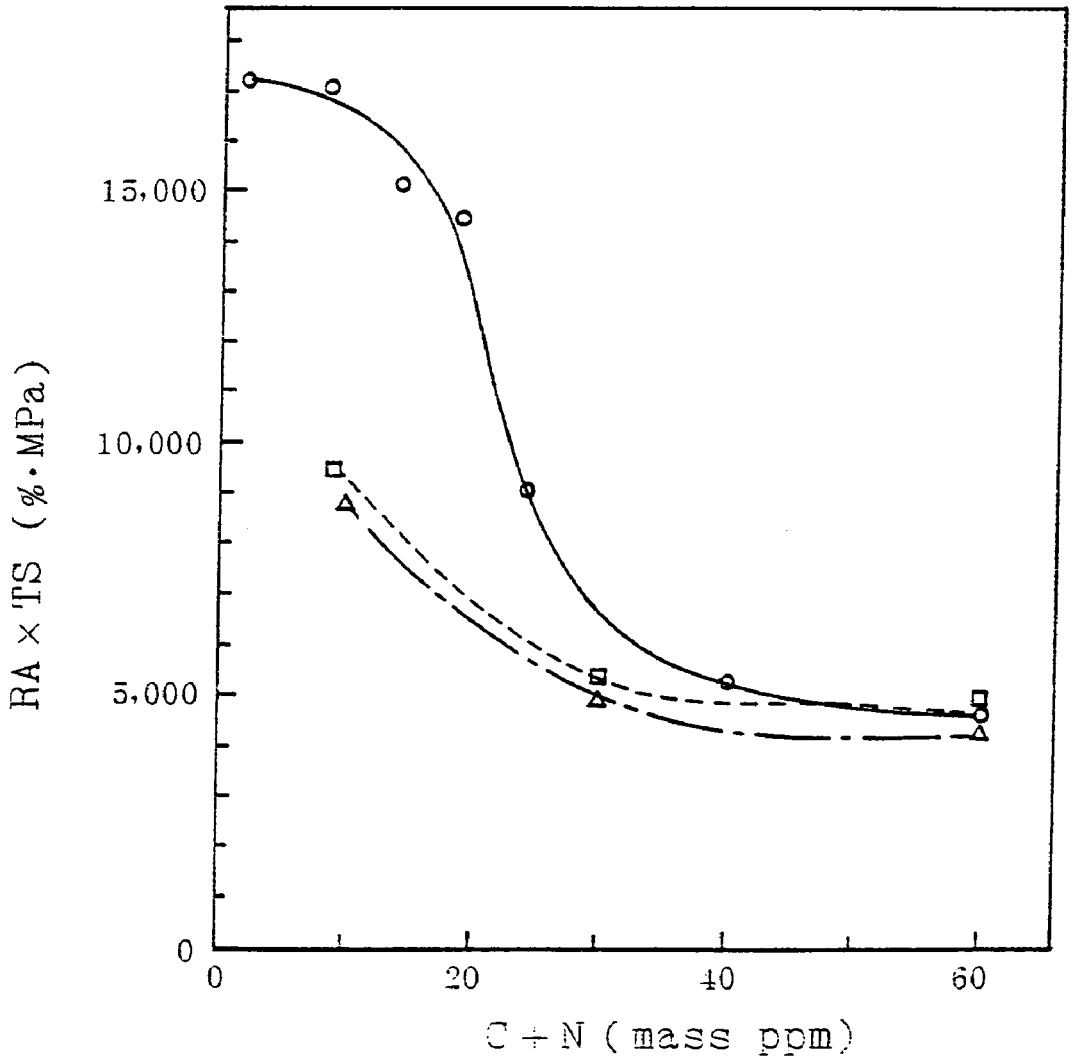
FIG. 1 is a graph showing a relation between strength-ductility balance at 1100° C. and C+N amount.

Firstly, there is described an experiment arriving at the invention.

Various Cr-based alloys containing 65 mass % of Cr are produced by changing purities of starting materials and melting conditions and shaped into rod-shaped specimens of 25 mm by hot forging. In this case, hot forging→working→reheating→hot forging are repeated with respect to alloys hardly working into a rod because of poor workability. These rod-shaped specimens are heated to 1250° C. and water-cooled, from which round specimens of 6.5 mm in diameter and 120 mm in length are cut out. The strength (tensile strength) and ductility (reduction of cross section) at 1100° C. are measured by using these round specimens by means of a high-temperature tensile testing machine of direct current system (Greeble testing machine).

In FIG. 1 is shown an influence of C+N amount upon strength-ductility balance (product of reduction of cross section RA by tensile strength TS) at a high temperature. From FIG. 1, it is understood that it is required to only decrease the C+N amount but also control S amount and O amount in order to provide RA·TS≧10000 (%·MPa) as a good region of strength-ductility balance at a high temperature zone. The invention is accomplished based on such a knowledge.

Thereason why the components according to the invention are restricted to the above ranges is described machine of direct current system (Greeble testing machine).

In FIG. 1 is shown an influence of C+N amount upon strength-ductility balance (product of reduction of cross section RA by tensile strength TS) at a high temperature. From FIG. 1, it is understood that it is required to only decrease the C+N amount but also control S amount and O amount in order to provide RA·TS≧10000 (%·MPa) as a good region of strength-ductility balance at a high temperature zone. The invention is accomplished based on such a knowledge.

The reason why the components according to the invention are restricted to the above ranges is described below.

Cr: not less than 60 mass %

Cr is an element required for ensuring the strength at the high temperature. When the amount is less than 60 mass %, it is difficult to ensure the strength above 1000° C., so that it is required to be not less than 60 mass %. Moreover, it is favorable to be not less than 65 mass % in order to develop sufficient properties. And also, the upper limit of Cr amount is not particularly restricted, but 99.99 mass % is critical from a viewpoint of production by melting.

C+N: not more than 20 mass ppm

C and N form carbonitride of Cr below 1000° C. to bring about brittleness of Cr-based alloy and degradation of corrosion resistance. And also, C and N are existent at a solid solution state at a high temperature zone above 1000° C. to lower the ductility. In order not to bring about the degradation of these properties, C+N are required to be not more than 20 mass ppm. Moreover, in order to more lessen the degradation of the ductility, C+N are favorable to be not more than 10 mass ppm. Furthermore, the lower limit is not particularly restricted, but it is desirable to be 0.1 mass ppm considering the melt production time in industry.

S: not more than 20 mass ppm

S exists in form of a sulfide with a slight amount of a metallic element such as Ti, Cu, Mn or the like slightly included in the Cr-based alloy, or segregates in a grain boundary at a solid solution state. In any case, it brings about the degradation of the ductility. Such a degradation of the ductility becomes remarkable when the S amount exceeds 20 mass ppm, so that the upper limit is 20 mass ppm. Moreover, in order to more lessen the degradation of the ductility, it is desirable to control the S amount to not more than 10 mass ppm. And also, the lower limit of the S amount is not particularly restricted, but it is desirable to be 0.1 mass ppm considering the melt producing cost.

O (total O): not more than 100 mass ppm, O as an oxide: not more than 50 mass ppm O forms an oxide with a slight amount of a metallic element such as Al, Si or the like slightly included in the Cr-based alloy to bring about the degradation of the ductility. In order to avoid such a bad influence, it is necessary that the O amount (total O amount) is restricted to not more than 100 mass ppm and the O amount existing as an oxide is controlled to not more than 50 mass ppm. Moreover, in order to maintain the high ductility, it is favorable that the O amount is not more than 50 mass ppm and the O amount as an oxide is not more than 30 mass ppm. The lower limits of the O amount and the O amount as an oxide are not restricted, but they are preferable to be 5 mass ppm and 3 mass ppm, respectively, considering the melt producing cost.

In addition to the aforementioned elements, there are Fe and inevitable impurities. Moreover, the reason why the remaining element is Fe is due to the fact that Cr—Fe alloy is most advantageous from a viewpoint of the ductility and the cost.

The alloy according to the invention has excellent strength and ductility at a high temperature region above 1000° C. Such an alloy can be particularly produced according to usual manner except that starting materials having a higher purity are used and melting conditions are paid attention to. In this case, it is desirable that chromium of not less than 99.9 mass % is used as the starting material and the melting conditions are the use of skull melting process being less in incorporation of impurities from a crucible and the vacuum degree of $10^{-5}$ Torr.

EXAMPLE

Various Cr-based alloys having a chemical composition as shown in Table 1 are produced by melting. In the melt production, a high purity chromium (purity: 99.95 mass %) and a super-high purity electrolytic iron (purity: 99.998 mass %) are used and a skull melting process using a water-cooled copper crucible is adopted. The resulting ingot is hot forged at 950–1200° C. (forging is carried out by repeating hot forging→working→reheating→hot forging at a temperature region more giving a ductility) to form a rod-shaped specimen of 25 mm.

The rod-shaped specimen is heated to 1250° C. and water-cooled, from which is cut out a round specimen of 6.5 mm in diameter and 120 mm in length. The ductility (reduction of cross section) at a high temperature is measured with respect to such a specimen by means of a high-temperature tensile testing machine of direct current system (Greeble testing machine). For the comparison, the same test is carried out with respect to 54Ni-18Cr-3Mo alloy (Inconel 718) as a commercial heat-resistant material.

TABLE 1

| Alloy | Cr/ mass % | C + N/ mass ppm | S/ mass ppm | O/ mass ppm | O as Oxide/ mass ppm | Remarks |
|---|---|---|---|---|---|---|
| A | 50 | 0.9 | 0.6 | 9 | 4 | Comparative Example |
| B | 50 | 31 | 18 | 17 | 9 | Comparative Example |
| C | 65 | 1.2 | 0.9 | 5 | 3 | Example |
| D | 65 | 7.5 | 8.1 | 20 | 13 | Example |
| E | 65 | 8.2 | 7.7 | 80 | 40 | Example |
| F | 65 | 25 | 9.3 | 80 | 30 | Comparative Example |
| G | 65 | 9.1 | 32.2 | 60 | 25 | Comparative Example |
| H | 65 | 8.2 | 7.6 | 110 | 70 | Comparative Example |
| I | 70 | 9.1 | 9.5 | 31 | 26 | Example |
| J | 80 | 2.6 | 3.8 | 31 | 22 | Example |
| K | 90 | 5.4 | 6.2 | 32 | 22 | Example |
| L | ≧99.9 | 9.8 | 7.5 | 44 | 29 | Example |
| M | 54Ni—18Cr—3.0Mo—18.5Fe | | — | — | — | Conventional Example |

The measured results of high-temperature tensile test are shown in Table 2. In the alloys A and B containing less than 60 mass % of Cr, the strength at the high temperature lowers. And also, 54Ni-18Cr-3Mo alloy used as a heat-resistant material from the old time violently lowers the ductility above 1000° C. and renders RA at 1200° C. into 0%.

On the contrary, the invention alloys indicate RA·TS≧10000 (%·MPa) showing a strength-ductility balance at a high temperature above 1000° C. and have a very excellent strength-ductility balance.

TABLE 2

| | RA (%) | | | | | TS (MPa) | | | | |
|---|---|---|---|---|---|---|---|---|---|---|
| Alloy | 900° C. | 1000° C. | 1050° C. | 1100° C. | 1200° C. | 900° C. | 1000° C. | 1050° C. | 1100° C. | 1200° C. |
| A | 82 | 78 | 81 | 89 | 92 | 195 | 160 | 121 | 100 | 75 |
| B | 47 | 62 | 65 | 68 | 72 | 235 | 150 | 120 | 90 | 70 |
| C | 79 | 87 | 93 | 98 | 100 | 339 | 243 | 210 | 176 | 131 |
| D | 72 | 85 | 89 | 93 | 95 | 325 | 241 | 205 | 168 | 124 |
| E | 65 | 80 | 84 | 87 | 91 | 291 | 233 | 197 | 160 | 115 |
| F | 58 | 81 | 61 | 62 | 79 | 280 | 210 | 151 | 148 | 112 |
| G | 45 | 53 | 54 | 59 | 67 | 276 | 228 | 156 | 152 | 107 |
| H | 54 | 62 | 63 | 68 | 72 | 271 | 223 | 150 | 142 | 99 |
| I | 72 | 84 | 69 | 93 | 98 | 335 | 242 | 210 | 177 | 128 |
| J | 66 | 82 | 86 | 90 | 96 | 332 | 240 | 210 | 180 | 142 |
| K | 68 | 80 | 85 | 89 | 96 | 331 | 236 | 209 | 182 | 146 |
| L | 69 | 80 | 84 | 87 | 95 | 331 | 238 | 212 | 185 | 150 |
| M | 84 | 86 | 21 | 8 | 0 | 462 | 315 | 264 | 212 | 49 |

| | RA × TS (% · MPa) | | | | | |
|---|---|---|---|---|---|---|
| Alloy | 900° C. | 1000° C. | 1050° C. | 1100° C. | 1200° C. | Remarks |
| A | 15990 | 12480 | 9801 | 8900 | 6900 | Comparative Example |
| B | 11045 | 9300 | 7800 | 6120 | 5040 | Comparative Example |
| C | 26781 | 21141 | 19379 | 17248 | 13100 | Example |
| D | 23400 | 20485 | 18201 | 15624 | 11780 | Example |
| E | 18915 | 18640 | 16408 | 13920 | 10465 | Example |
| F | 16240 | 12810 | 8211 | 9178 | 8848 | Comparative Example |
| G | 12420 | 12084 | 8424 | 8968 | 7169 | Comparative Example |
| H | 14634 | 13826 | 9450 | 9656 | 7128 | Comparative Example |
| I | 24120 | 20328 | 18541 | 16461 | 12544 | Example |
| J | 21912 | 19680 | 18060 | 16200 | 13632 | Example |
| K | 22508 | 18880 | 17661 | 16198 | 14016 | Example |
| L | 22839 | 19040 | 17660 | 16095 | 14260 | Example |
| M | 38808 | 27090 | 5534 | 1696 | 0 | Conventional Example |

As mentioned above, according to the invention, there can be provided Cr-based alloys having an excellent strength-ductility balance at a higher temperature above 1000° C., particularly above 1050° C. Therefore, the invention conduces in various industry fields requiring a high-temperature material and largely contributes to the improvement of earth environment.

What is claimed is:

1. A Cr-based alloy having an excellent strength-ductility balance at higher temperature, comprising Cr: not less than 65 mass %, C+N: not more than 20 mass ppm, S: not more than 20 mass ppm, O not more than 100 mass ppm, O as an oxide: not more than 50 mass ppm, and the remainder being Fe and inevitable impurities.

2. A Cr-based alloy according to claim 1, having a strength-ductility balance of RA·TS≧10000 (%·MPa) at higher than 1000° C.

3. A Cr-based alloy described in claim 1, having strength-ductility balance of RA·TS≧10000 (%·MPa) at 1050° C.–1200° C.

4. A process of making an alloy as described in claim 1, wherein a starting material of chromium has not less than 99.9% of purity.

5. The process according to claim 4, wherein a starting material of iron is a super-high purity electrolytic iron with a purity of 99.998%.

6. The process according to claim 4 comprising a skull melting process using a water-cooled copper crucible.

* * * * *